US009827607B2

(12) United States Patent
Lin et al.

(10) Patent No.: US 9,827,607 B2
(45) **Date of Patent: *Nov. 28, 2017**

(54) MOLD FOR MOLDING A CASE OF A MOBILE DEVICE AND MOLDING METHOD FOR MANUFACTURING A CASE OF A MOBILE DEVICE

(71) Applicant: AISA VITAL COMPONENTS CO., LTD., New Taipei (TW)

(72) Inventors: Kuo-Sheng Lin, New Taipei (TW); Fei-Fei Shi, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 196 days.

This patent is subject to a terminal disclaimer.

(21) Appl. No.: 14/718,224

(22) Filed: May 21, 2015

(65) Prior Publication Data

US 2016/0339505 A1 Nov. 24, 2016

(51) Int. Cl.
*B21J 5/06* (2006.01)

(52) U.S. Cl.
CPC ..... *B21J 5/06* (2013.01)

(58) Field of Classification Search
CPC ..... B21D 22/02; B21D 22/06; B21D 37/02; B21D 37/04; B21D 37/08; B21D 37/10; B21D 37/14; B21D 17/22; B21D 7/02; B21D 7/021; B21D 7/022; B21D 26/02; B21D 26/021; B21D 53/80; B30B 15/02; B21J 13/02; B21J 13/025; B21J 5/02; B21J 5/06
See application file for complete search history.

(56) References Cited

U.S. PATENT DOCUMENTS

| | | | | |
|---|---|---|---|---|
| 6,519,852 | B1 * | 2/2003 | Chen | B21D 53/30 29/894.353 |
| 7,578,223 | B2 * | 8/2009 | Bliss | B21D 22/02 72/446 |
| 7,621,168 | B2 * | 11/2009 | Lin | B21D 37/08 470/162 |
| 9,566,629 | B2 * | 2/2017 | Lin | B21D 37/14 |

* cited by examiner

*Primary Examiner* — R. K. Arundale
*Assistant Examiner* — Pradeep C Battula
(74) *Attorney, Agent, or Firm* — Jackson IPG PLLC; Demian K. Jackson

(57) ABSTRACT

A mold for molding a case of a mobile device includes a first, second, third, fourth and fifth main body, connection slide blocks, and first and second abutment slide blocks. The connection slide blocks and the second abutment slide blocks are inlaid in first and second slide channels of the first and second main bodies. The first abutment slide blocks are inlaid in channels of the connection slide blocks. The third, fourth and fifth main bodies are horizontally movable relative to the first and second main bodies. The first and second main bodies, the connection slide blocks and the first and second abutment slide blocks together define a male mold section and the third, fourth and fifth main bodies together define a female mold section. A metal thin sheet is placed on the male mold section and pressurized and molded by the female mold section to form the case.

7 Claims, 16 Drawing Sheets

MOLD FOR MOLDING A CASE OF A MOBILE DEVICE AND MOLDING METHOD FOR MANUFACTURING A CASE OF A MOBILE DEVICE

BACKGROUND OF THE INVENTION

1. Field of the Invention

The present invention relates generally to a mold for molding a case of a mobile device and a molding method for manufacturing a case of a mobile device, and more particularly to a mold for molding a case of a mobile device and a method of using the mold to manufacture the case of the mobile device.

2. Description of the Related Art

Currently, the mobile devices such as handheld mobile phones, tablets and other 3C products have higher and higher operation performance. As a result, along with the promotion of the operation performance, the heat generated by the internal chips of the mobile device is continuously increased. No matter whether a vapor chamber or a heat pipe or a graphite plate is used to transfer the heat, the heat must be transferred to outer side of the device to dissipate. In order to stress the appearance and sense of quality or provide novel style, some mobile device manufacturers often selectively manufacture the case of the handheld device from plastic or other nonmetal material.

Through some tests, it is proved that the metal-made case of the handheld device still has better heat dissipation effect. To manufacture a metal-made handheld device case, a CNC processing apparatus is mainly used to cut and process metal blocks so as to achieve a thin metal case body. When using a CNC processing apparatus to cut or mill and process the metal block, the CNC processing apparatus removes the unneeded parts of the material to achieve the product. It is quite time-consuming to cut and process the material so that the manufacturing time is prolonged to lead to increase of cost. Moreover, the selection of the cutting blade and the wear of the cutting blade are also great problems in consideration of processing cost.

Furthermore, the purchase of the CNC processing apparatus is the major cost in the manufacturing. This is because the multiaxial CNC processing apparatus is much more expensive than other CNC processing apparatuses. In addition, the operator must have the ability to draft the processing program and know how to operate the CNC processing apparatus. Therefore, the cost for training the operator is another issue that should be taken into consideration. The multiaxial CNC processing apparatus is quite sophisticated and complicated. Therefore, the service and maintenance cost for the multiaxial CNC processing apparatus is also very high.

Also, when using the CNC processing apparatus to cut and process the material, it is necessary to use a great amount of cutting fluid to lower the temperature. Some kinds of cutting fluids cannot be recovered and recycled. As a result, the cutting fluids will lead to pollution of the environment.

It is therefore tried by the applicant to improve the manufacturing process of the handheld device case so as to lower the manufacturing cost.

Some other manufacturers try to manufacture the handheld device case by punching. However, with respect to a relatively complicated structure such as a structure with a round corner or arched or curved face, it often takes place that the material cannot be de-molded to achieve the product. This problem needs to be overcome.

At the present stage, the mainstream of the manufacturing process of the handheld device case is still to manufacture the handheld device case from plastic material by injection molding or use the CNC processing apparatus to process the metal case. However, the manufacturing process still needs to be improved so as to achieve a metal case with both good sense of quality and better heat dissipation effect at much lower manufacturing cost.

SUMMARY OF THE INVENTION

It is therefore a primary object of the present invention to provide a mold for molding a case of a mobile device. By means of the mold, the case of the mobile device can be manufactured by molding.

It is a further object of the present invention to provide a molding method for manufacturing a case of a mobile device.

It is still a further object of the present invention to provide the above mold for molding a case of a mobile device, which can manufacture the case of the mobile device at lower manufacturing cost.

It is still a further object of the present invention to provide the above molding method for manufacturing a case of a mobile device, which can manufacture the case of the mobile device at lower manufacturing cost.

To achieve the above and other objects, the mold for molding a case of a mobile device of the present invention includes a first main body, a second main body, multiple connection slide blocks, a third main body, a fourth main body, a fifth main body, multiple first abutment slide blocks and multiple second abutment slide blocks.

The first main body has an upper side and a lower side. A periphery of the first main body has multiple first slide channels. The second main body is correspondingly disposed under a lower side of the first main body. Multiple second slide channels are formed on four corners of the second main body and correspondingly extend to four corners of the first main body. The connection slide blocks are respectively correspondingly inlaid in the second slide channels and slidable relative to the first and second main bodies. Each connection slide block has a channel. The third main body is correspondingly disposed on right side of the first main body and horizontally movable relative to the first main body. The third main body has a first arched recess on one side adjacent to the first main body. The fourth main body is correspondingly disposed on left side of the first main body and horizontally movable relative to the first main body. The fourth main body has a second arched recess on one side adjacent to the first main body. The fifth main body is correspondingly disposed on front side of the first main body and horizontally movable relative to the first main body. The fifth main body has a third arched recess on one side adjacent to the first main body. The first abutment slide blocks are respectively correspondingly inlaid in the channels and slidable relative to the first and second main bodies. The second abutment slide blocks are respectively correspondingly inlaid in the first slide channels. The first and second main bodies and the connection slide blocks and the first and second abutment slide blocks together define a male mold section. The third, fourth and fifth main bodies together define a female mold section. The male and female mold sections are connectable with each other to form a mold cavity.

By the conventional technique, it is impossible to manufacture a metal mobile device case by molding. The mold for molding a case of a mobile device of the present invention overcomes the shortcoming of the conventional technique. By means of the mold for molding a case of a mobile device of the present invention, a metal mobile device case can be manufactured by molding. Moreover, the mold can be used to manufacture the mobile device case at much lower manufacturing cost.

Still to achieve the above and other objects, the molding method for manufacturing a case of a mobile device of the present invention includes steps of:

providing a mold for molding a case of a mobile device and a metal thin sheet;

placing the metal thin sheet on upper side of the male mold section;

forcedly mating the female mold section with the male mold section to shape the metal thin sheet into a configuration identical to that of the mold cavity;

forcedly separating the female mold section from the male mold section to demold the material;

moving the first abutment slide blocks and the connection slide blocks of the male mold section in a direction away from the metal thin sheet to demold the metal thin sheet;

moving the second abutment slide blocks of the male mold section in a direction away from the metal thin sheet and removing the second abutment slide blocks so as to completely demold the shaped case of the mobile device; and completing the molding process.

By the conventional technique, it is impossible to manufacture a metal mobile device case by molding. The mold for molding a case of a mobile device and the molding method for manufacturing a case of a mobile device of the present invention overcome the shortcoming of the conventional technique. By means of the mold for molding a case of a mobile device of the present invention, a metal mobile device case can be manufactured by molding. Moreover, the mold can be used to manufacture the mobile device case at much lower manufacturing cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
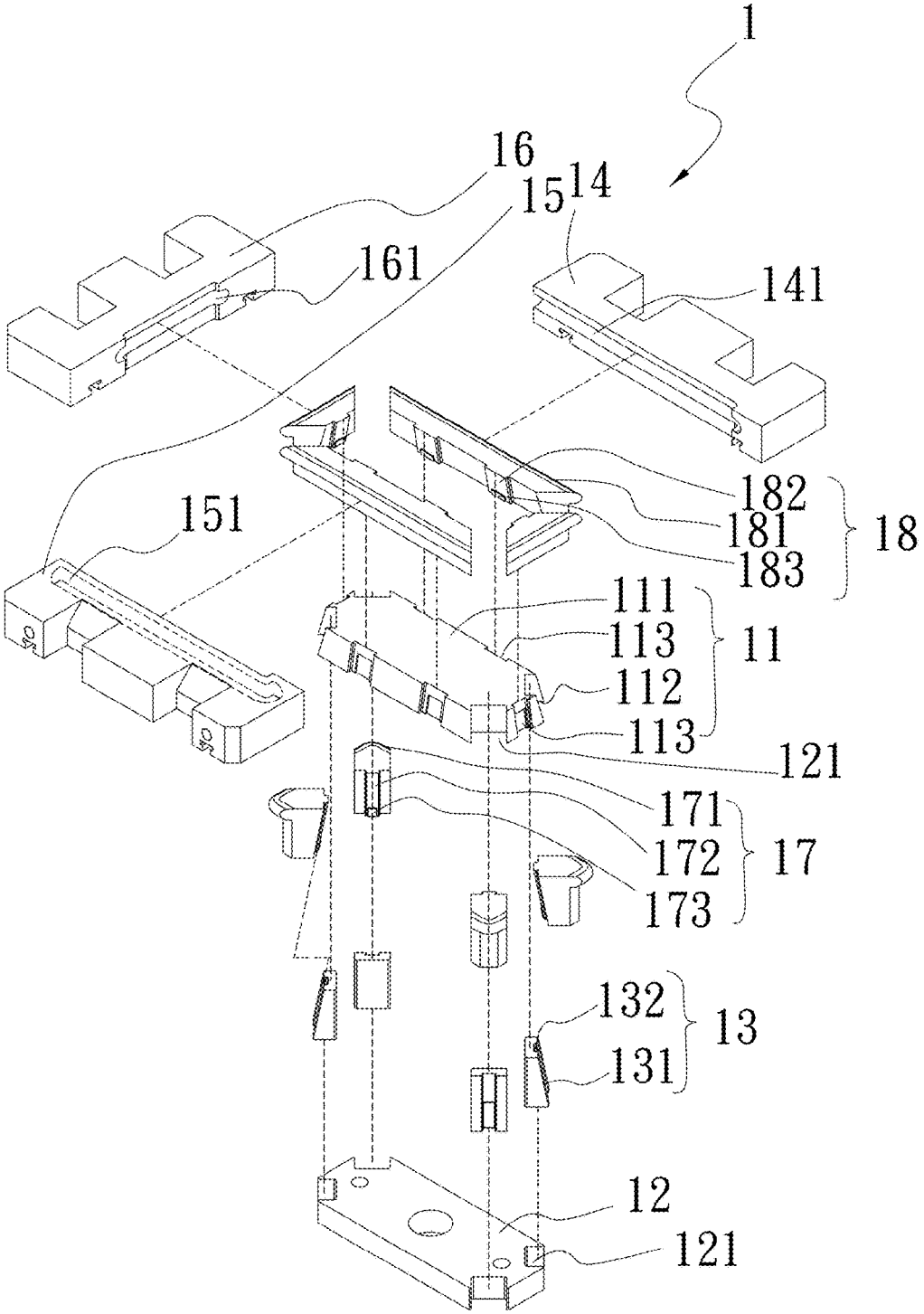
FIG. 1 is a perspective exploded view of a first embodiment of the mold for molding a case of a mobile device of the present invention.
Figure 2:
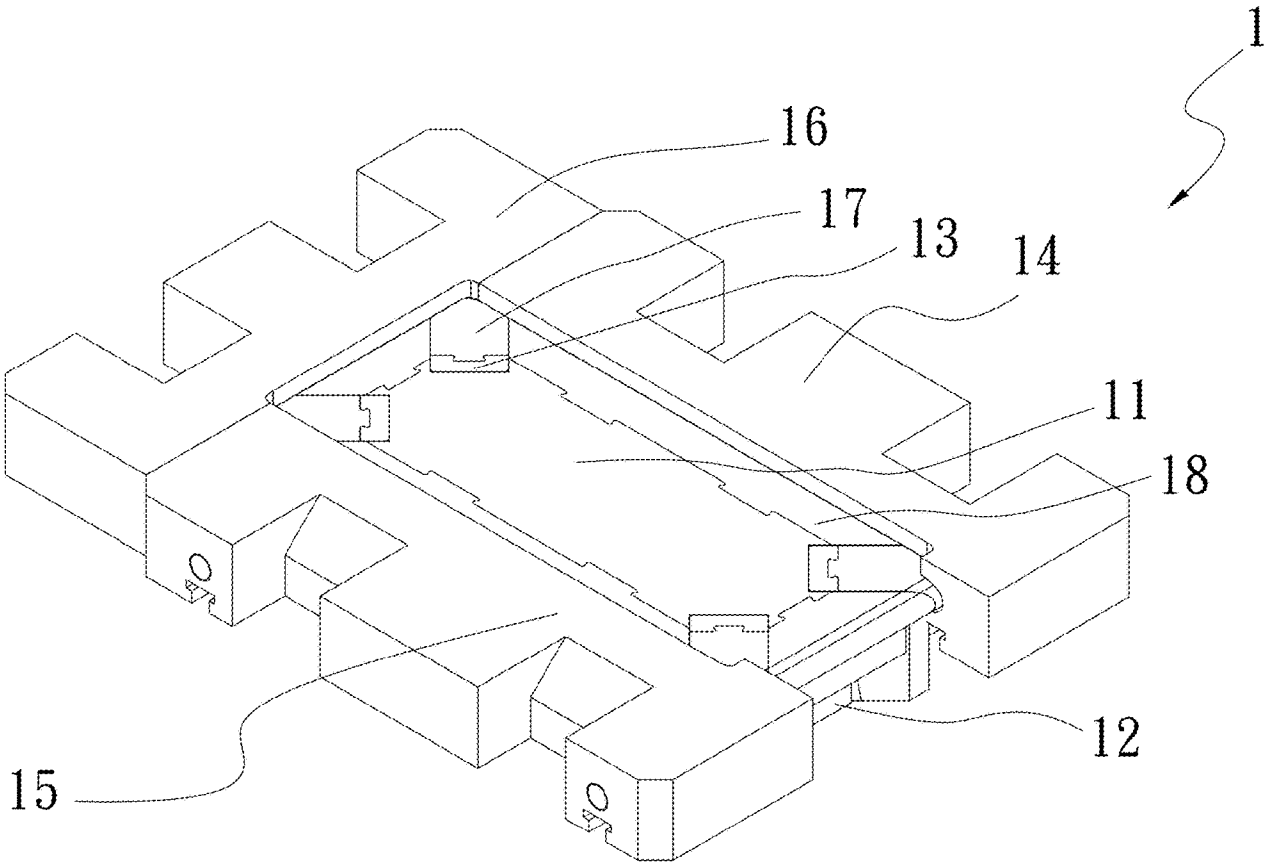
FIG. 2 is a perspective assembled view of the first embodiment of the mold for molding a case of a mobile device of the present invention.
Figure 2A:
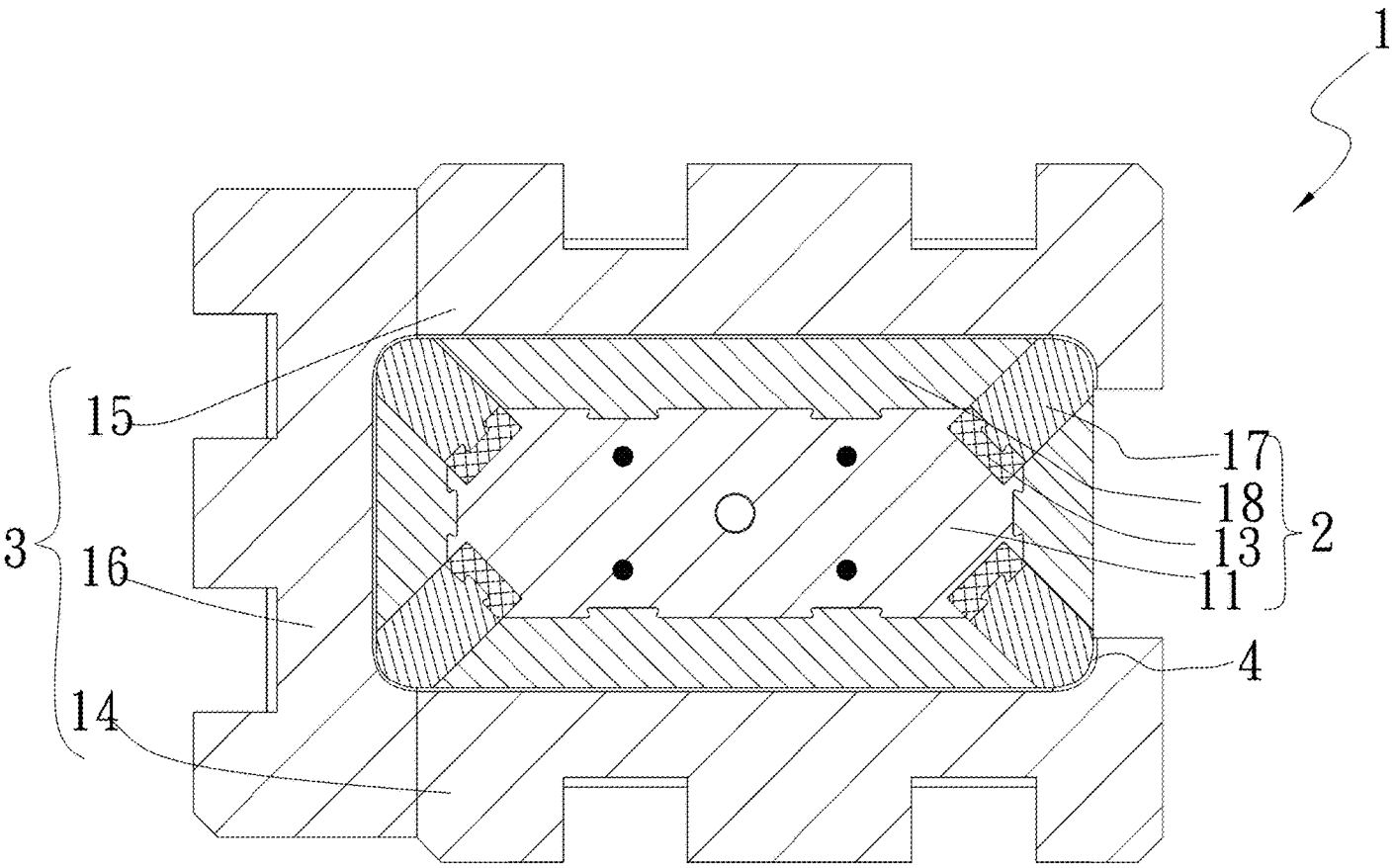
FIG. 2A is a sectional assembled view of the first embodiment of the mold for molding a case of a mobile device of the present invention.

Please refer to FIGS. 1, 2 and 2A. FIG. 1 is a perspective exploded view of a first embodiment of the mold for molding a case of a mobile device of the present invention. FIG. 2 is a perspective assembled view of the first embodiment of the mold for molding a case of a mobile device of the present invention. FIG. 2A is a sectional assembled view of the first embodiment of the mold for molding a case of a mobile device of the present invention. According to the first embodiment, the mold 1 for molding a case of a mobile device of the present invention includes a first main body 11, a second main body 12, multiple connection slide blocks 13, a third main body 14, a fourth main body 15, a fifth main body 16, multiple first abutment slide blocks 17 and multiple second abutment slide blocks 18.

The first main body 11 has an upper side 111 and a lower side 112. The periphery of the first main body 11 has multiple first slide channels 113. The first slide channels 113 are respectively formed on left and right sides and front and rear sides of the first main body 11.

The second main body 12 is correspondingly disposed under the lower side of the first main body 11. The periphery of the second main body 12 has multiple second slide channels 121. The second slide channels 121 are formed on four corners of the second main body 12 and extend to four corners of the first main body 11 corresponding to the four corners of the second main body 12. The first main body 11 is a trapezoid hexahedron body. Due to the trapezoid hexahedron form of the first main body 11, the first slide channels 113 formed on the periphery, (that is, the left, right, front and rear sides) of the main body 11 are inclined from the first main body 11.

The connection slide blocks 13 are respectively correspondingly inlaid in the second slide channels 121 and slidable relative to the first and second main bodies 11, 12. Each connection slide block 13 has the form of a rectangular triangular hexahedron body. The connection slide block 13 has a hypotenuse 131 on which a channel 132 is formed.

The third main body 14 is correspondingly disposed on the right side of the first main body 11 and horizontally movable relative to the first main body 11 (toward or away from the first main body 11). The third main body 14 has a first arched recess 141 on one side adjacent to the first main body 11.

The fourth main body 15 is correspondingly disposed on the left side of the first main body 11 and horizontally movable relative to the first main body 11 (toward or away from the first main body 11). The fourth main body 15 has a second arched recess 151 on one side adjacent to the first main body 11.

The fifth main body 16 is correspondingly disposed on the front side of the first main body 11 and horizontally movable relative to the first main body 11 (toward or away from the first main body 11). The fifth main body 16 has a third arched recess 161 on one side adjacent to the first main body 11.

The first abutment slide blocks 17 are respectively correspondingly inlaid in the channels 132 and slidable relative to the first and second main bodies 11, 12. The channels 132 are formed on the hypotenuses 131 of the connection slide blocks 13 so that the first abutment slide blocks 17 are obliquely slidable relative to the first and second main bodies 11, 12. Each first abutment slide block 17 has an abutment section 171 and an insertion section 172 respectively disposed on outer edge and inner edge of the first abutment slide block 17. The insertion section 172 has a restriction protrusion block 173 near bottom side of the first abutment slide block 17. The abutment section 171 on outer edge of the first abutment slide block 17 has the form of a convex face.

The second abutment slide blocks 18 are respectively correspondingly inlaid in the first slide channels 113 of the first main body 11. Each second abutment slide block 18 has an abutment section 181 and an insertion slide section 182 respectively disposed on outer edge and inner edge of the second abutment slide block 18. The insertion slide section 182 has a restriction protrusion section 183 near bottom side of the second abutment slide block 18. The abutment section 181 on outer edge of the second abutment slide block 18 has the form of a convex face.

The abutment sections 171, 181 of the first and second abutment slide blocks 17, 18 in the form of a convex face correspond to the first, second and third arched recesses 141, 151, 161 of the third, fourth and fifth main bodies 14, 15, 16.

The first and second main bodies 11, 12 and the connection slide blocks 13 and the first and second abutment slide blocks 17, 18 together define a male mold section 2. The third, fourth and fifth main bodies 14, 15, 16 together define a female mold section 3. When the top sides of the connection slide blocks 13 and the first and second abutment slide blocks 17, 18 are flush with the upper side 111 of the first main body 11, the shape of the male mold section 2 is formed. When the female mold section 3 together defined by the third, fourth and fifth main bodies 14, 15, 16 horizontally moves to get close to the male mold section 2, a mold cavity 4 is formed.

Figure 3:
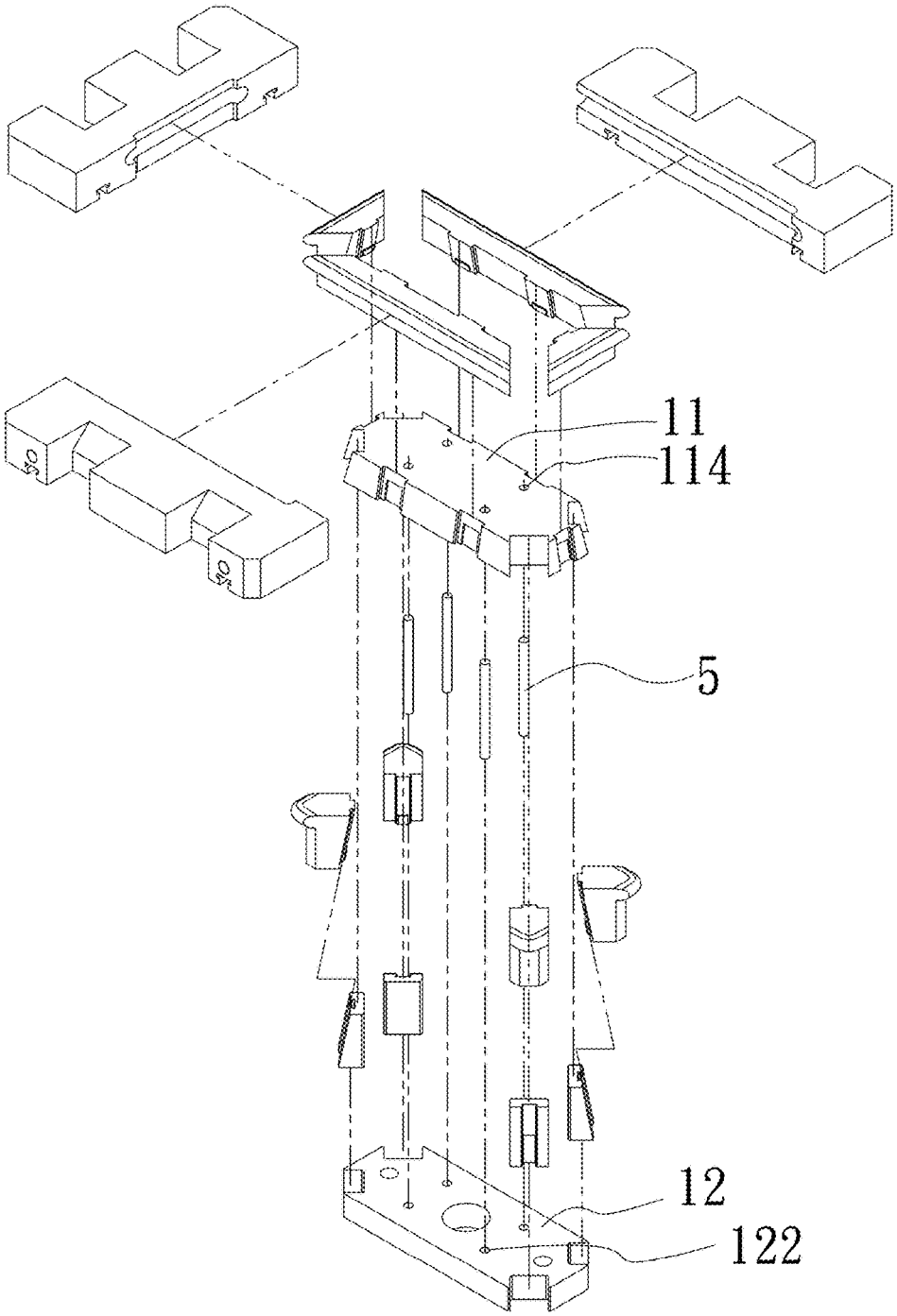
FIG. 3 is a perspective exploded view of a second embodiment of the mold for molding a case of a mobile device of the present invention.

Please now refer to FIG. 3, which is a perspective exploded view of a second embodiment of the mold for molding a case of a mobile device of the present invention. As shown in FIG. 3, the second embodiment is partially identical to the first embodiment in structure and thus will not be repeatedly described hereinafter. The second embodiment is different from the first embodiment in that the first and second main bodies 11, 12 further have multiple through holes 114, 122 and multiple push pins 5. The through holes 114, 122 are positioned in alignment with each other. The push pins 5 are respectively correspondingly fitted in the through holes 114, 122 of the first and second main bodies 11, 12 and up and down movable relative to the first and second main bodies 11, 12. The push pins 5 serve to help in separating a work piece from the surface of the first main body 11 in demolding process.

Figure 4:
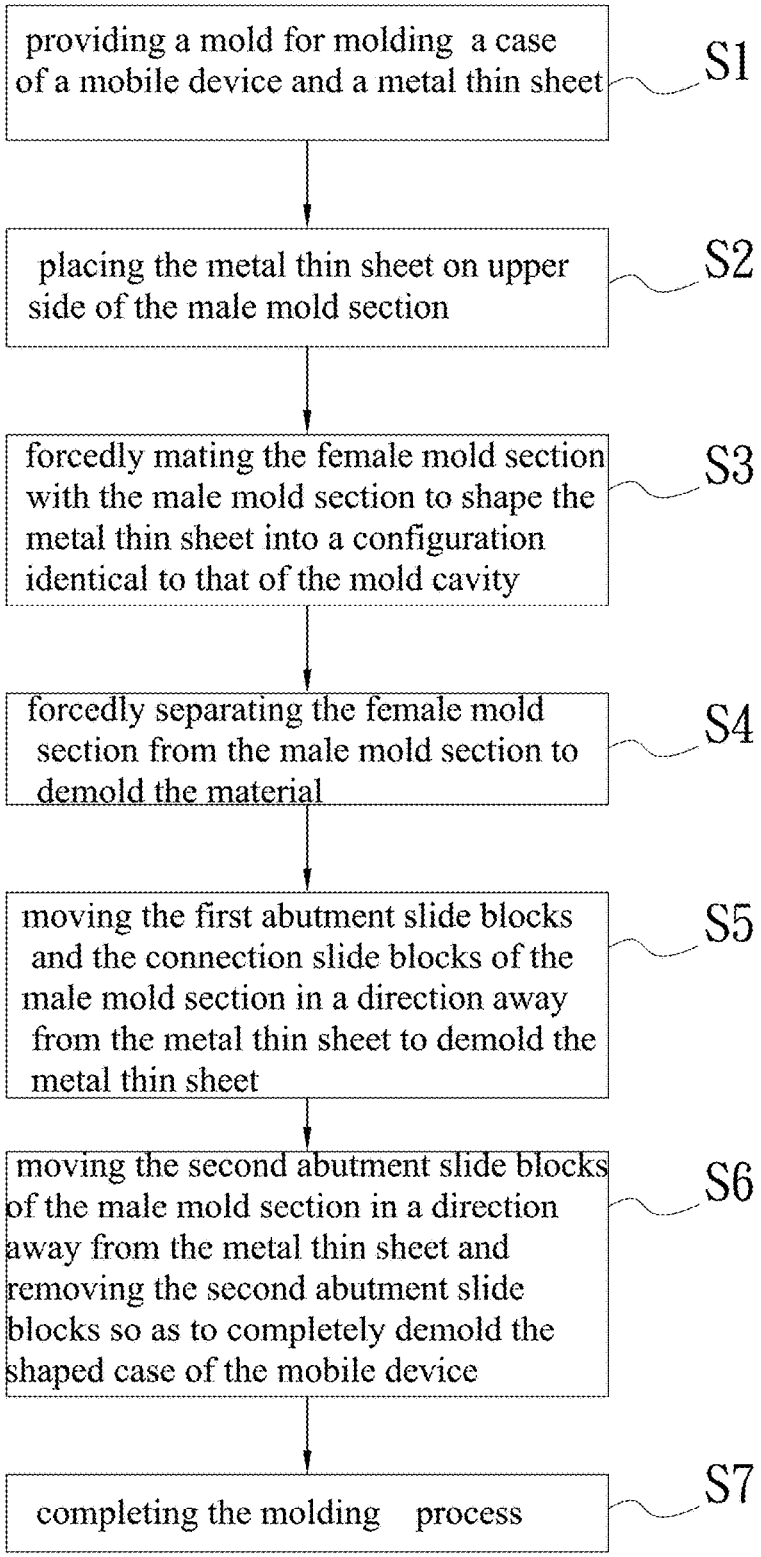
FIG. 4 is a flow chart of the molding method for manufacturing a case of a mobile device of the present invention.
Figure 5:
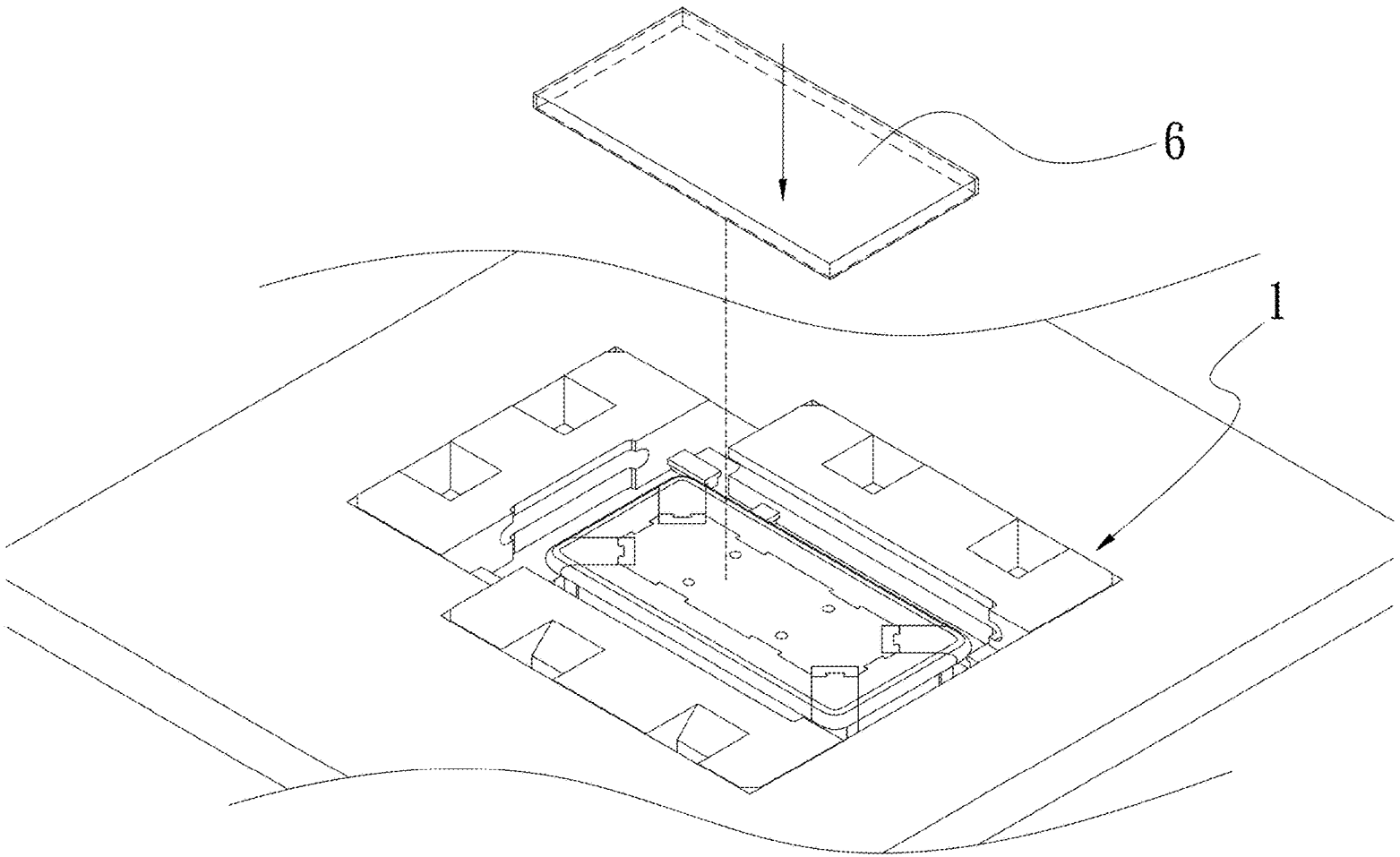
FIG. 5 is a view showing the molding method for manufacturing a case of a mobile device of the present invention.
Figure 5A:
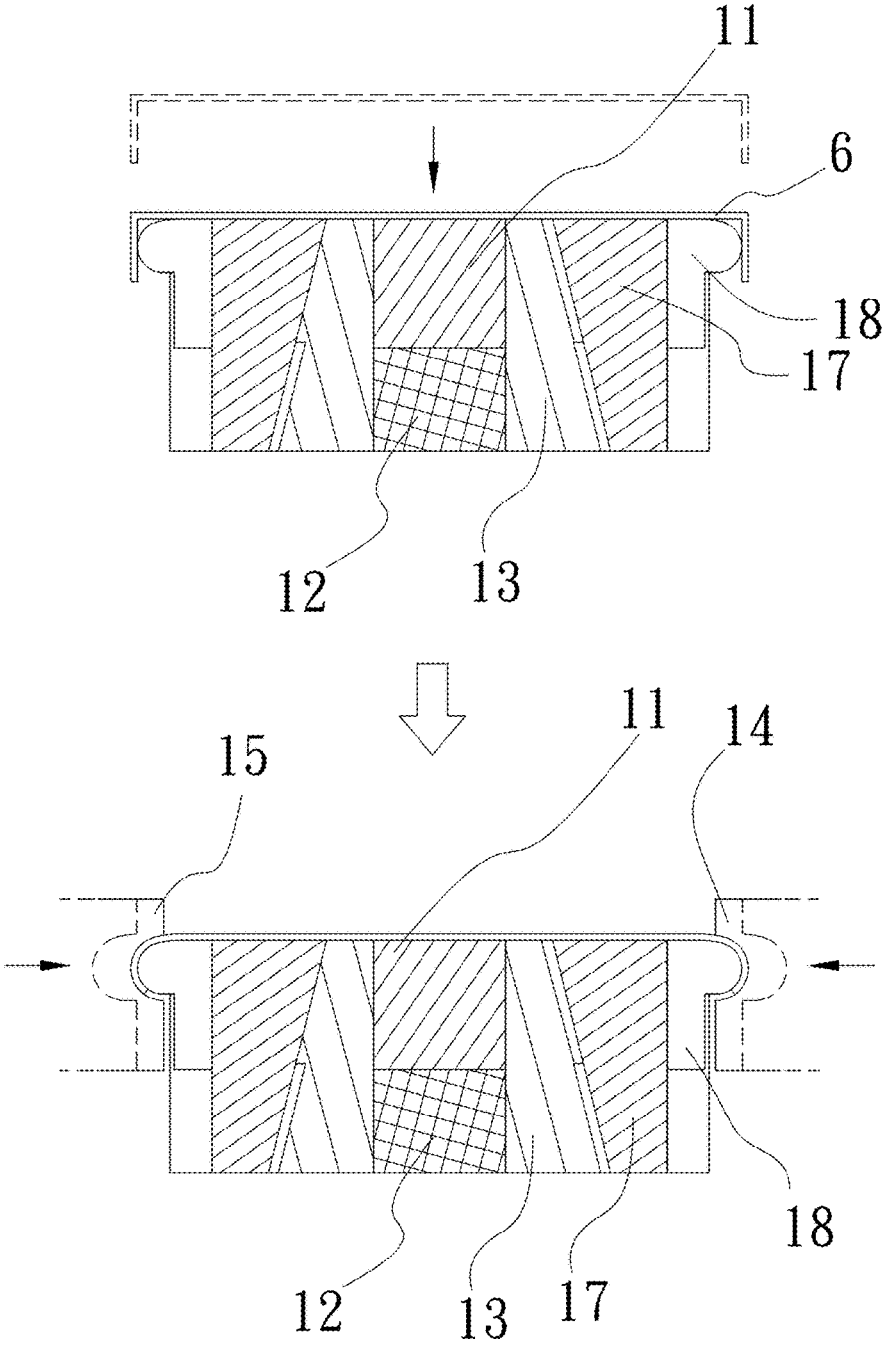
FIG. 5A is a view showing the molding method for manufacturing a case of a mobile device of the present invention.
Figure 6:
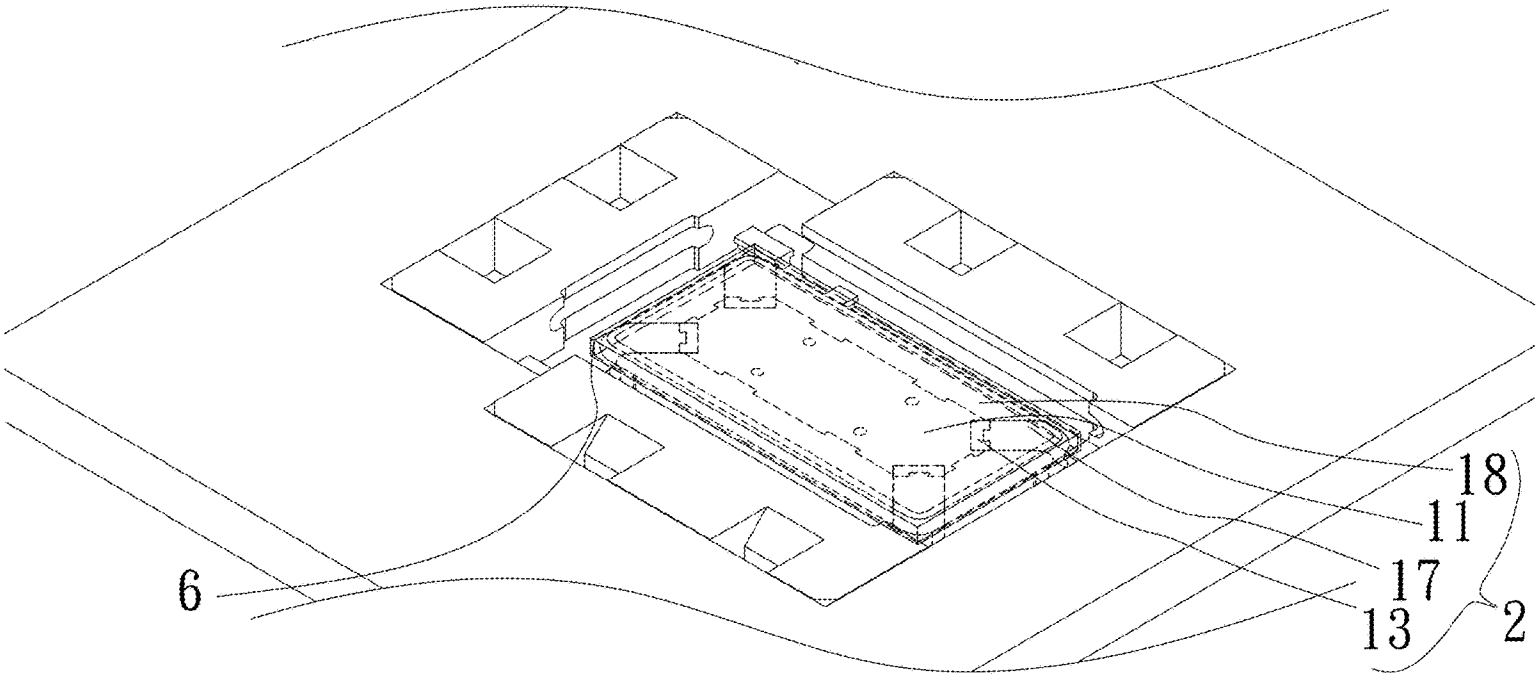
FIG. 6 is a view showing the molding method for manufacturing a case of a mobile device of the present invention.
Figure 7:
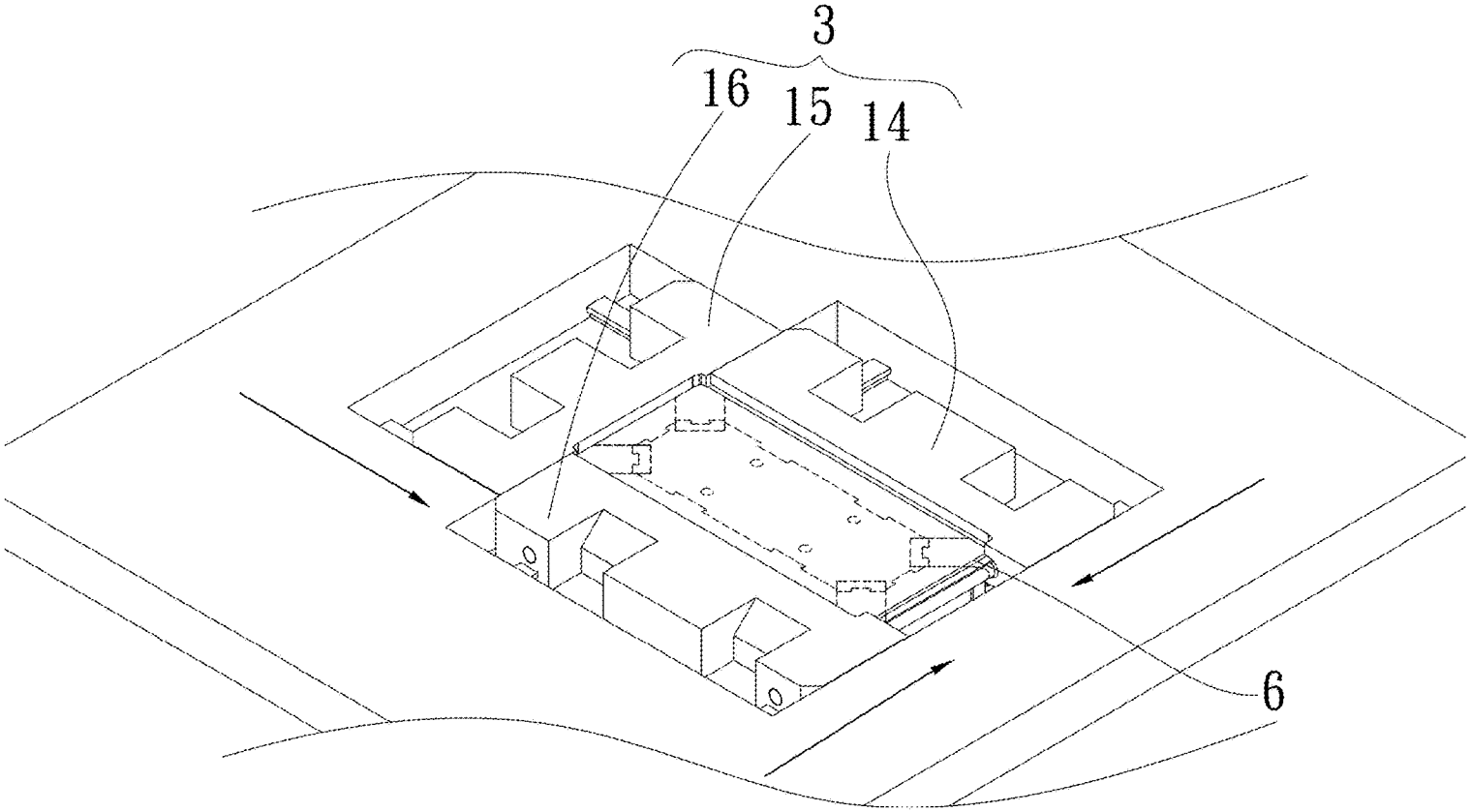
FIG. 7 is a view showing the molding method for manufacturing a case of a mobile device of the present invention.
Figure 8:
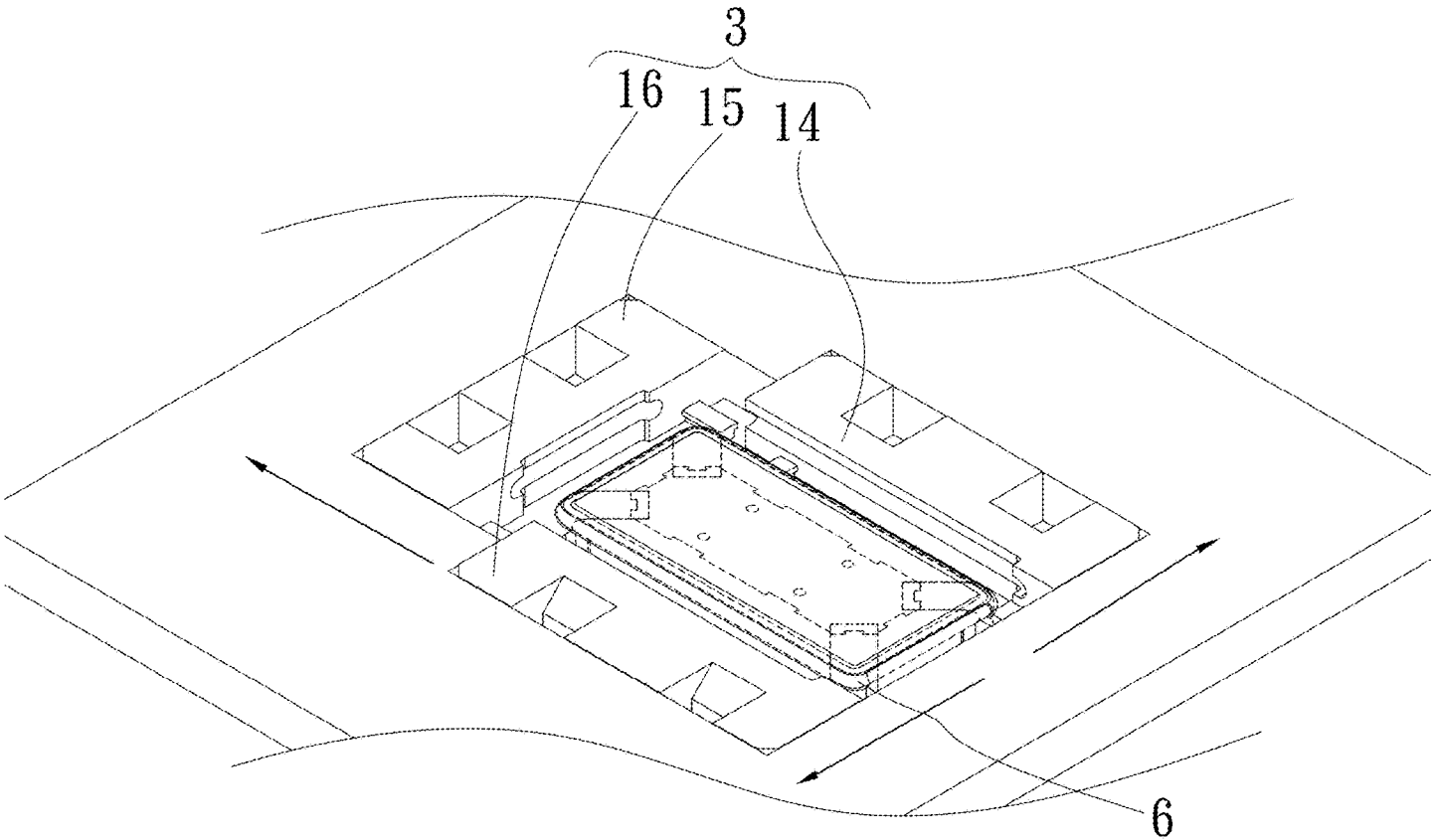
FIG. 8 is a view showing the molding method for manufacturing a case of a mobile device of the present invention.
Figure 8A:
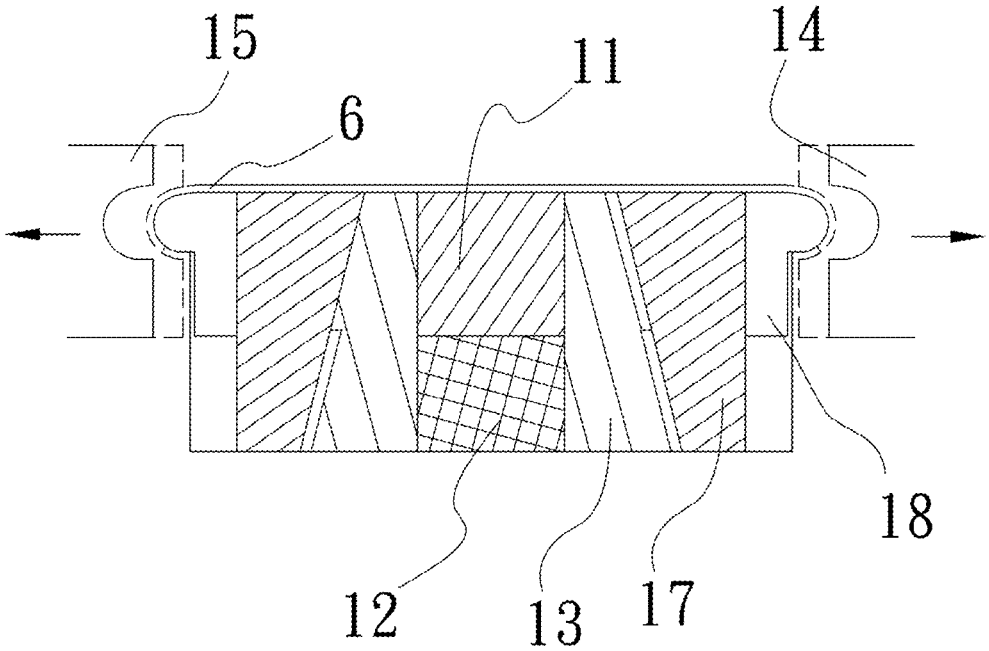
FIG. 8A is a view showing the molding method for manufacturing a case of a mobile device of the present invention.
Figure 9:
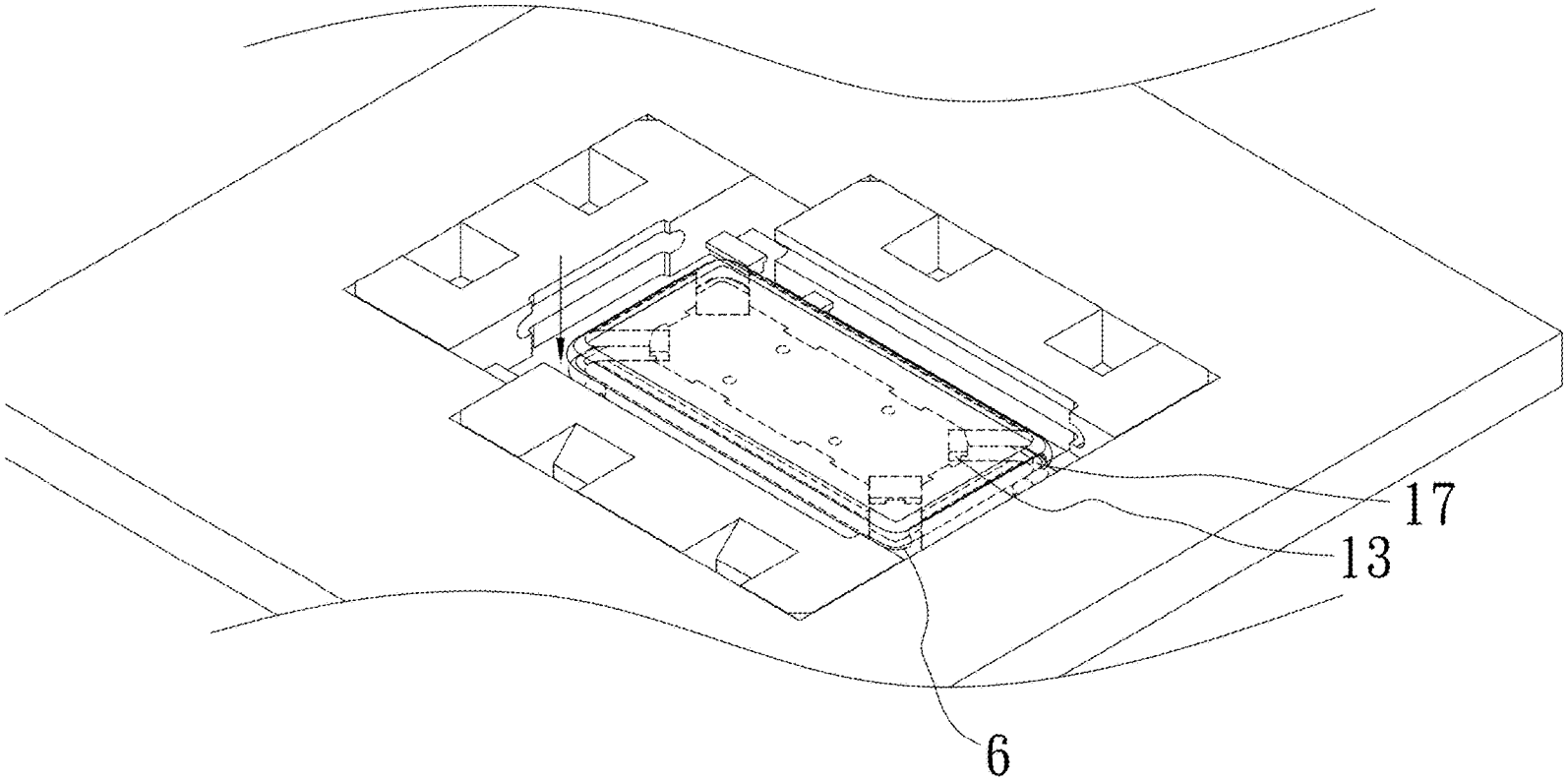
FIG. 9 is a view showing the molding method for manufacturing a case of a mobile device of the present invention.
Figure 9A:
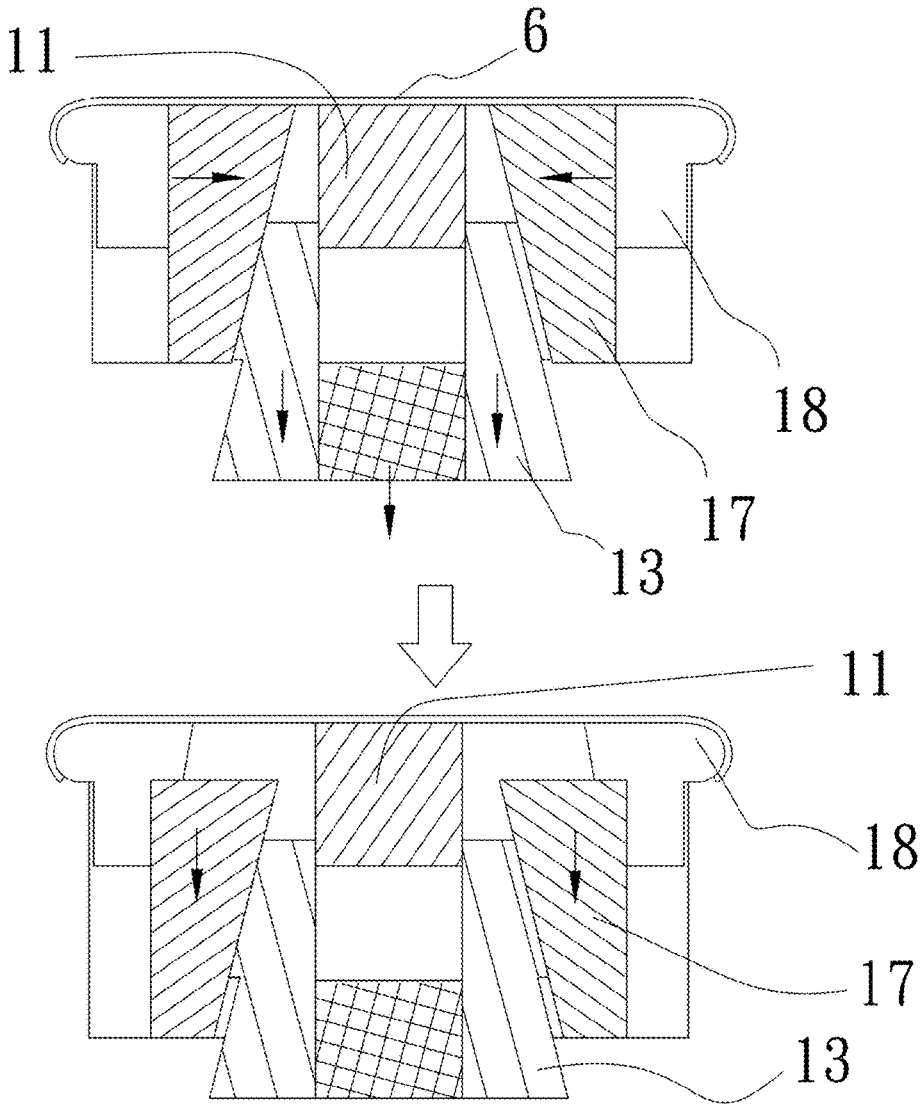
FIG. 9A is a view showing the molding method for manufacturing a case of a mobile device of the present invention.
Figure 10:
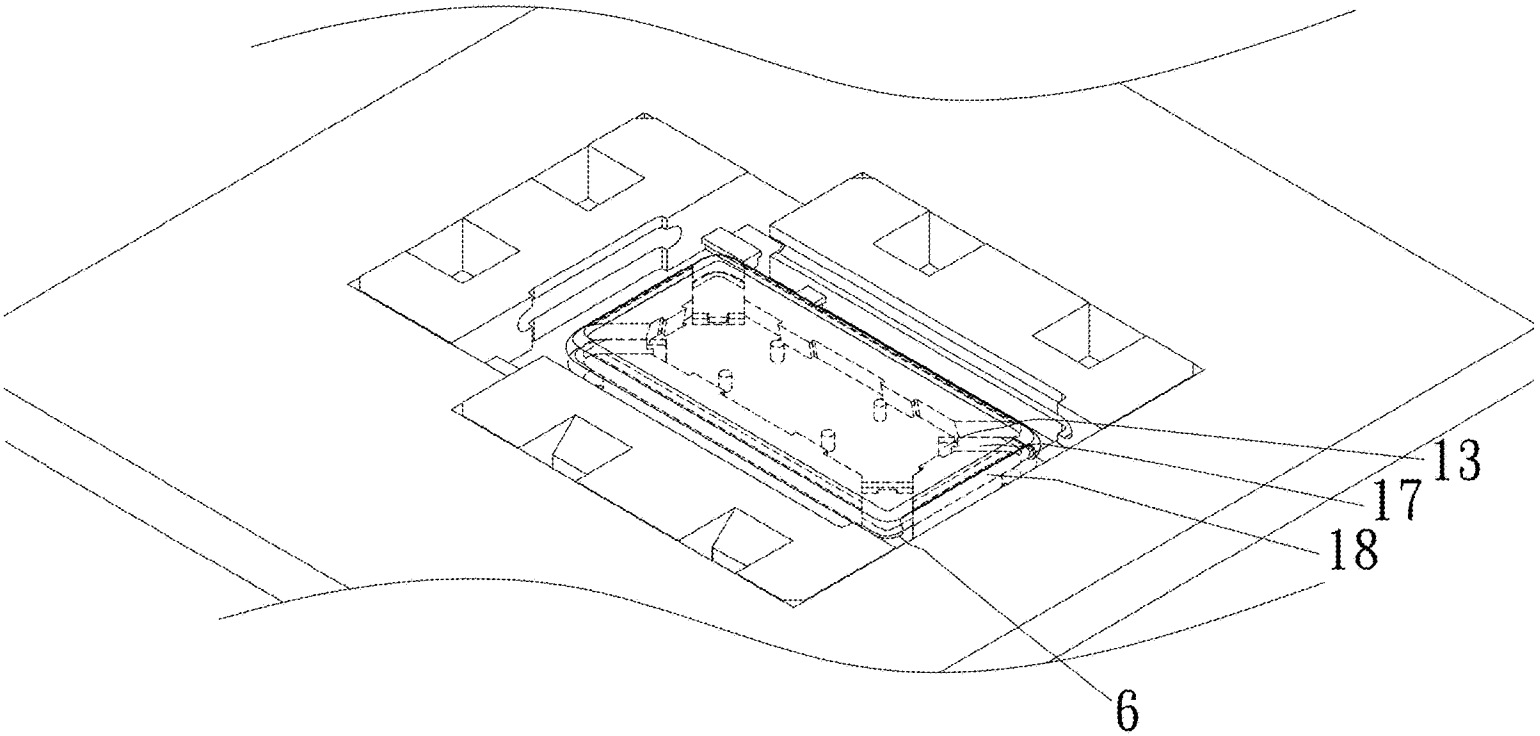
FIG. 10 is a view showing the molding method for manufacturing a case of a mobile device of the present invention.
Figure 11:
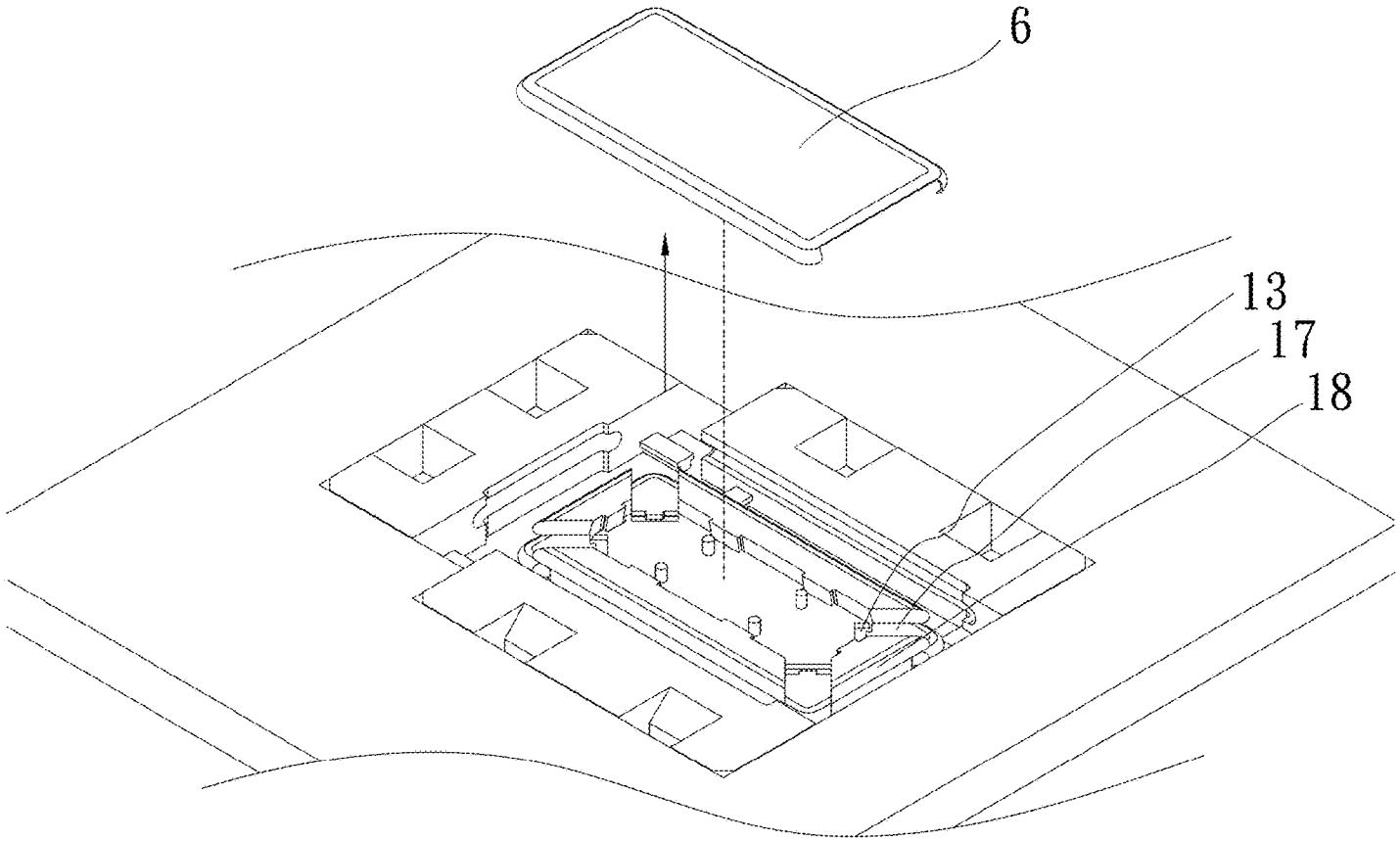
FIG. 11 is a view showing the molding method for manufacturing a case of a mobile device of the present invention.
Figure 11A:
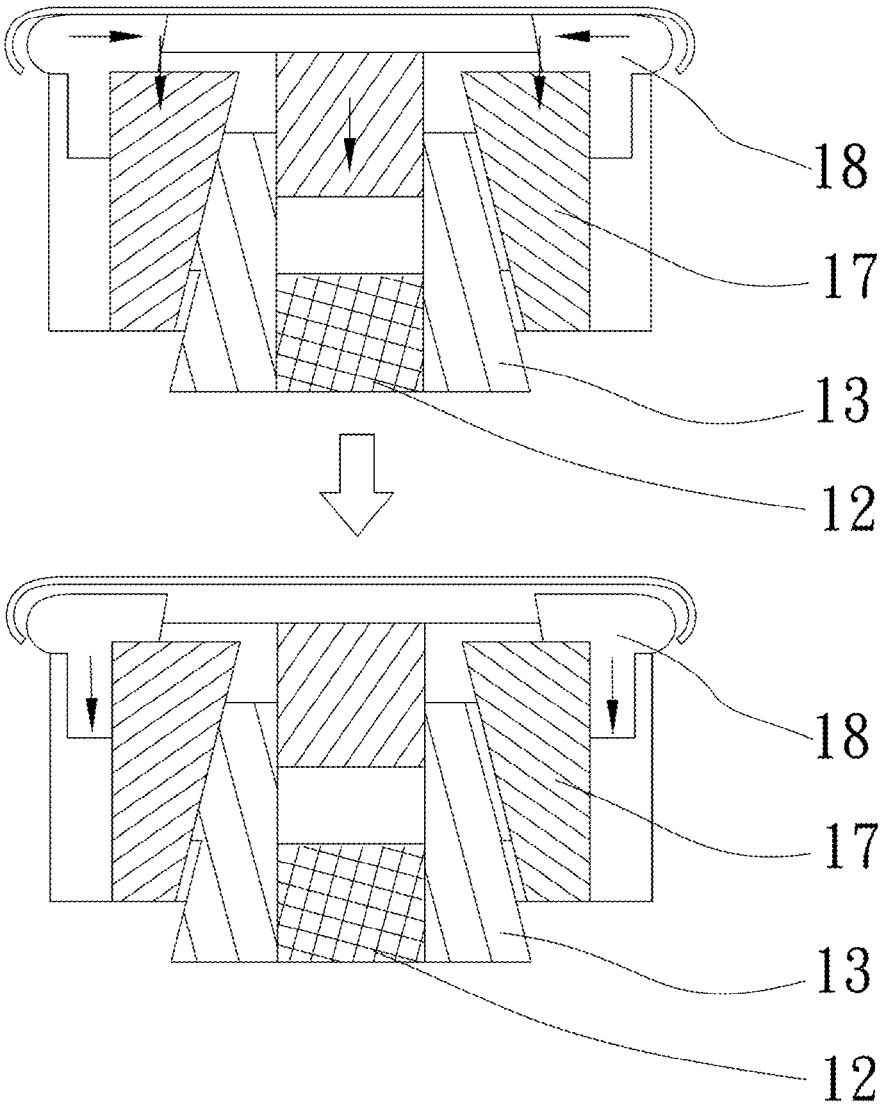
FIG. 11A is a view showing the molding method for manufacturing a case of a mobile device of the present invention.

Please now refer to FIG. 4, which is a flow chart of the molding method for manufacturing a case of a mobile device of the present invention. Also referring to FIGS. 1, 2, 5, 5A, 6, 7, 8, 8A, 9, 9A, 10 and 11, the molding method for manufacturing a case of a mobile device of the present invention includes steps of:

S1. providing a mold for molding a case of a mobile device and a metal thin sheet, a metal thin sheet 6 being selected to manufacture the case of the mobile device, the metal thin sheet 6 being a metal material selected from a group consisting of copper, aluminum, magnesium, stainless steel, iron and alloys thereof for manufacturing the metal mobile device case, the metal thin sheet 6 being placed into the mold 1 for molding the case of the mobile device as shown in FIGS. 1, 2, 2A, 5 and 5A), the metal thin sheet 6 being previously shaped into a U-shaped piece (as shown by phantom lines of FIG. 5A);

S2. placing the metal thin sheet on upper side of the male mold section, the metal thin sheet 6 being placed on the male mold section, which is together defined by the first and second main bodies 11, 12 and the connection slide blocks 13 and the first and second abutment slide blocks 17, 18 (as shown in FIGS. 5, 5A and 6);

S3. forcedly mating the female mold section with the male mold section to shape the metal thin sheet into a configuration identical to that of the mold cavity, a molding apparatus being used to apply an external force to the female mold section 3 so as to get the female mold section 3 close to the male mold section 2 and mate the female mold section 3 with the male mold section 2, the abutment sections 171, 181 (male mold section) of the first and second abutment slide blocks 17, 18 in the form of convex face being forcedly mated with the first, second and third arched recesses 141, 151, 161 (female mold section) of the third, fourth and fifth main bodies 14, 15, 16, whereby the metal thin sheet 6 is shaped into a structure body with a configuration identical to that of the mold cavity 4, that is, the left, right, upper and lower sides of the metal thin sheet 6 being formed with convex faces as the male mold section 2 (as shown in FIGS. 1, 2, 2A, 5A and 7);

S4. forcedly separating the female mold section from the male mold section to demold the material, after the female mold section 3 is mated with the male mold section 2 to shape the metal thin sheet 6 into a structure body with a configuration identical to that of the mold cavity 4, the female mold section 3 being moved in a direction away from the male mold section 2 to demold the material (as shown in FIGS. 1, 2, 2A, 8 and 8A);

S5. moving the first abutment slide blocks and the connection slide blocks of the male mold section in a direction away from the metal thin sheet to demold the metal thin sheet, after the female mold section 3 is separated from the male mold section 2, the material (metal thin sheet 6) being immediately demolded, in order to successfully demold the molded and processed metal thin sheet 6 from the male mold section 2, the first abutment slide blocks 17 and the connection slide blocks 13 being operated to move in a direction away from the metal thin sheet 6 to demold the metal thin sheet 6, first, the connection slide blocks 13 disposed on four corners of the first main body 11 and the first abutment slide blocks 17 inlaid in the connection slide blocks 13 being slid in a direction away from the first main body 11, the connection slide blocks 13 connected with the first main body 11 and the first abutment slide blocks 17 being first moved in a direction away from the metal thin sheet 6, (that is, moved toward lower side of the first main body 11), each connection slide block 13 having the form of a rectangular triangular hexahedron body and the first abutment slide block 17 being disposed on the hypotenuse 131 of the connection slide block 13 so that when the first abutment slide blocks 17 are moved in a direction away from the metal thin sheet 6, the first abutment slide blocks 17 get close to the center of the first main body 11 (as shown in FIG. 9A) to first separate from the arched recessed faces on inner side of the metal thin sheet 6 and then move toward the lower side of the first main body 11 so that the originally abutted metal thin sheet 6 can be successfully retreated and separated (as shown in FIGS. 1, 2, 2A, 9, 9A and 10);

S6. moving the second abutment slide blocks of the male mold section in a direction away from the metal thin sheet and removing the second abutment slide blocks so as to completely demold the shaped mobile device case, after the first abutment slide blocks 17 and the connection slide block 13 are successfully moved in a direction away from the metal thin sheet 6 and removed, the second abutment slide blocks 18 being immediately moved in a direction away from the metal thin sheet 6 and removed, the first main body 11 being a trapezoid hexahedron body so that when the second abutment slide blocks 18 are relatively slid toward the first main body 11, the second abutment slide blocks 18 are obliquely slid (first moved toward the center of the first main body) to first separate from the arched recessed faces on inner side of the metal thin sheet 6 and then move toward the lower side of the first main body 11, whereby the second abutment slide blocks 18 can be successfully separated from the arched recessed faces on inner side of the originally abutted metal thin sheet 6 and removed to completely demold the metal thin sheet 6 (as shown in FIGS. 1, 2, 2A, 11, and 11A); and S7. completing the molding process, after the first and second abutment slide blocks 17, 18 and the connection slide blocks 13 are successfully separated from the molded and processed metal thin sheet 6, the molding process being completed to achieve the case of the mobile device by means of molding.

The mold for molding a case of a mobile device of the present invention is divided into multiple slide blocks. When demolded, the slide blocks are retreated in different sequences so that the molded and processed metal thin sheet 6 can be successfully demold.

In the molding method of the present invention, the process can be a punching process. The pressure source of the punching process can be a pneumatic pressure source or a hydraulic pressure source. This means that the mold 1 for molding a case of a mobile device of the present invention is applicable to a puncher or a press.

In the molding method of the present invention, the mold 1 for molding a case of a mobile device of the present invention can be applied to another cold forging molding apparatus. The mold 1 for molding a case of a mobile device of the present invention can be used in cooperation with the cold forging apparatus, whereby the case of the mobile device can be manufactured by molding. Also, the problem of the conventional technique that the molded and processed work piece cannot be demolded is solved.

Therefore, no matter whether the case of the mobile device is manufactured by one-time molding (punching processing) or multiple sequential punching molding processes (cold forging processing), the mold and the manufacturing method of the present invention are both applicable. A CNC processing apparatus can be further used to micro-process the material, (such as perforate, fine-modify and debur the material) so as to shorten the manufacturing time and save the material and lower the manufacturing cost.

The molding method of the present invention can manufacture the case of the mobile device by molding to greatly save the material cost and improve the problem of waste of a great amount of material of the conventional technique due to cutting of the CNC processing apparatus. Moreover, the pollution of environment due to the great amount of cutting fluid used in the cutting process can be avoided. In addition, the mold 1 for molding a case of a mobile device of the present invention solves the problem of the conventional technique that the work piece cannot be successfully demolded and it is impossible to manufacture a case of a mobile device by molding.

The present invention has been described with the above embodiments thereof and it is understood that many changes and modifications in the above embodiments can be carried out without departing from the scope and the spirit of the invention that is intended to be limited only by the appended claims.

What is claimed is:

1. A molding method for manufacturing a case of a mobile device, comprising steps of:

providing a mold for molding a case of a mobile device and a metal thin sheet, wherein the mold for molding the case of the mobile device, comprises:

a first main body having an upper side and a lower side, a periphery of the first main body having multiple first slide channels;

a second main body correspondingly disposed under a lower side of the first main body, multiple second slide channels being formed on four corners of the second main body and correspondingly extending to four corners of the first main body;

multiple connection slide blocks respectively correspondingly inlaid in the second slide channels and slidable relative to the first and second main bodies, each connection slide block having a channel;

a third main body correspondingly disposed on right side of the first main body and horizontally movable relative to the first main body, the third main body having a first arched recess on one side adjacent to the first main body;

a fourth main body correspondingly disposed on left side of the first main body and horizontally movable relative to the first main body, the fourth main body having a second arched recess on one side adjacent to the first main body;

a fifth main body correspondingly disposed on front side of the first main body and horizontally movable relative to the first main body, the fifth main body having a third arched recess on one side adjacent to the first main body;

multiple first abutment slide blocks respectively correspondingly inlaid in the channels and slidable relative to the first and second main bodies; and multiple second abutment slide blocks respectively correspondingly inlaid in the first slide channels, the first and second main bodies and the connection slide blocks and the first and second abutment slide blocks together defining a male mold section, the third, fourth and fifth main bodies together defining a female mold section, the male and female mold sections being connectable with each other to form a mold cavity;

placing the metal thin sheet on upper side of the male mold section;

forcedly mating the female mold section with the male mold section to shape the metal thin sheet into a configuration identical to that of the mold cavity; forcedly separating the female mold section from the male mold section to demold the material;

moving the first abutment slide blocks and the connection slide blocks of the male mold section in a direction away from the metal thin sheet to demold the metal thin sheet;

moving the second abutment slide blocks of the male mold section in a direction away from the metal thin sheet and removing the second abutment slide blocks so as to completely demold the shaped case of the mobile device; and completing the molding process.

2. The molding method for manufacturing a case of a mobile device as claimed in claim 1, wherein in the demolding process, the connection slide blocks are first moved in a direction away from the metal thin sheet and then the first abutment slide blocks are moved in a direction away from the metal thin sheet.

3. The molding method for manufacturing a case of a mobile device as claimed in claim 1, wherein the molding apparatus is configured to perform a punching process and the pressure source for the punching process is a pneumatic pressure source or a hydraulic pressure source.

4. The molding method for manufacturing a case of a mobile device as claimed in claim 1, wherein the molding process is cold forging processing process.

5. The molding method for manufacturing a case of a mobile device as claimed in claim 1, wherein each connection slide block has the form of a rectangular triangular hexahedron body.

6. The molding method for manufacturing a case of a mobile device as claimed in claim 1, wherein the first main body is a trapezoid hexahedron body.

7. The molding method for manufacturing a case of a mobile device as claimed in claim 1, wherein each first abutment slide block has an abutment section and an insertion section respectively disposed on outer edge and inner edge of the first abutment slide block, the insertion section having a restriction protrusion block near bottom side of the first abutment slide block, the abutment section on outer edge of the first abutment slide block having the form of a convex face, the second abutment slide blocks being respectively correspondingly inlaid in the first slide channels of the first main body, each second abutment slide block having an abutment section and an insertion slide section respectively disposed on outer edge and inner edge of the second abutment slide block, the insertion slide section having a restriction protrusion section near bottom side of the second abutment slide block, the abutment section on outer edge of the second abutment slide block having the form of a convex face, the abutment sections of the first and second abutment slide blocks corresponding to the first, second and third arched recesses of the third, fourth and fifth main bodies.

* * * * *